United States Patent [19]

Mansfield

[11] Patent Number: 4,624,192

[45] Date of Patent: Nov. 25, 1986

[54] FLUIDIZED BED COMBUSTER PROCESS

[75] Inventor: Vaughn Mansfield, Gallatin, Tenn.

[73] Assignee: Mansfield Carbon Products, Nashville, Tenn.

[21] Appl. No.: 841,784

[22] Filed: Mar. 20, 1986

[51] Int. Cl.[4] ..... F23J 3/00

[52] U.S. Cl. ..... 110/344; 110/245; 110/270; 110/345; 110/347

[58] Field of Search ..... 110/270, 329, 343, 344, 110/345, 347, 245

[56] References Cited

U.S. PATENT DOCUMENTS

| | | | |
|---|---|---|---|
| 1,689,675 | 10/1928 | Lulofs | 110/263 |
| 2,730,997 | 1/1956 | Birkner | 122/4 R |
| 3,625,164 | 12/1971 | Spector | 110/342 |
| 4,109,590 | 8/1978 | Mansfield | 110/270 X |
| 4,270,469 | 6/1981 | Gall | 110/245 |
| 4,279,222 | 7/1981 | Pearce | 122/4 D |
| 4,481,892 | 11/1984 | Mah | 110/263 |
| 4,532,872 | 8/1985 | Anderson | 110/255 |
| 4,592,289 | 6/1986 | Pershing et al. | 110/345 |

FOREIGN PATENT DOCUMENTS

| | | | |
|---|---|---|---|
| 0020380 | 2/1980 | Japan | 110/345 |

*Primary Examiner*—Edward G. Favors

*Attorney, Agent, or Firm*—Nies, Webner, Kurz & Bergert

[57] ABSTRACT

A bed of high-sulfur coal is burned in transit through a furnace on a horizontal or inclined travelling grate. Low pressure air is fed upwardly through the bed in quantities sufficient to react with most of the carbon content of the coal, from which sulfureous gases arise. High pressure air is blasted upwardly through the remnants of the burning coal as they fall off the end of the grate run. Clinker content of the residue free-falls off the end of the grate run into a collector while burned or partly burned fines are elevated above the end of the grate run. High pressure air with entrained limestone blows the elevated particles back through the sulfureous atmosphere above the bed so as to react with the carbon content of the particles and grab the sulfur.

3 Claims, 1 Drawing Figure

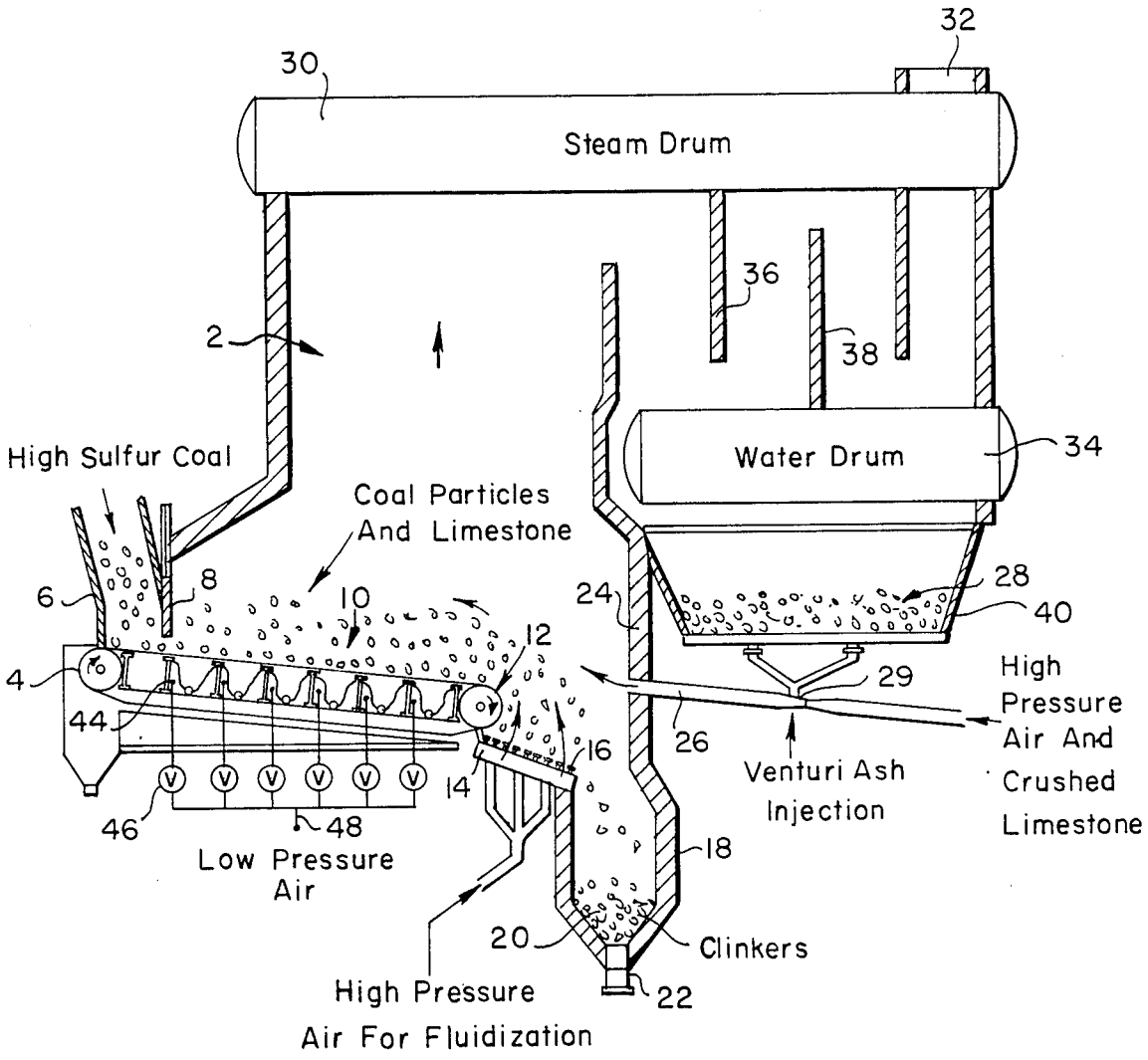
32
30
Steam Drum
36
38
2
Water Drum
34
High Sulfur Coal
Coal Particles
And Limestone
28
6
8
10
24
40
12
29
High
Pressure
Air And
Crushed
Limestone
4
44
26
16
Venturi Ash
Injection
14
46
48
Low Pressure
Air
18
20
Clinkers
22
High Pressure
Air For Fluidization

FLUIDIZED BED COMBUSTER PROCESS

OBJECTS

The primary object of this invention is to provide a process for the virtually complete combustion of high sulfur coal in a horizontal travelling grate furnace while removing the sulfur content of the combustion gases. While it has heretofore been known to elevate unreacted or partly reacted coal particles above a burning bed on a horizontal travelling grate furnace and to blast high pressure air laterally into the elevated particles so as to complete the burning thereof, ordinarily the high sulfur content of the exhaust gases requires subsequent removal at high costs. The object now is to entrain limestone particles in the lateral blast of air so as to grab the sulfur in the combustion gases before they leave the furnace. To this end it is now proposed to utilize the turbulent forces of the over-fire air blast not only to achieve virtually complete combustion of the small coal particles, or fines, but also as a means for comingling the limestone particles with the sulfur-laden combustion gases. This achieves substantially complete grabbing of the sulfur content of the combustion gases by the limestone particles.

As in some previous processes, the present one utilizes a horizontal or inclined travelling grate upon which a burning bed of coal is transported through a furnace while under-fire air is fed upwardly through the bed and over-fire air is blasted laterally through the particles which have been elevated above the bed. In at least some prior instances, the particles are elevated to above the bed by passing high pressure under-fire air through the bed. Not only does this make it difficult to reduce the rate of heat output of the furnace, if needed, but it also results in creation of grate damaging hotspots and channeling of air through the bed. Accordingly to this invention, an object is to feed the under-fire air through the bed at a slow rate commensurate with the demand of heat from the furnace and the input of coal into the furnace.

The invention is illustrated by the sole figure of the drawing which is a diagramatic vertical cross section through the furnace illustrating the operation of the process.

The process is performed in a furnace 2 having an endless horizontal travelling grate 4 onto which high sulfur coal is fed through an input chute 6. The coal is preferably sized to about one and a quarter inch by zero and is spread by guillotine gate 8 to form a bed 10 on the travelling grate, all as is well known in the art. The coal is nearly completely burned on the grate and the residue at the end of the grate run, consisting essentially of ashes, limestone, clinkers and unburned or partly burned small coal particles is dumped onto a manifold 14 through which high pressure air is supplied via jets 16. An ash bin 18 collects the clinkers and large ash particles 20, which are transported off by suitable conveyor 22. Through a wall 24 at the output end of the furnace extends a nozzle 26 through which high pressure air and limestone is blown. Small ash particles, and partly or incompletely burned small particles of coal are reinjected by a venturi 29 into the stream of high pressure air and limestone.

As the small particles of unburned or partly burned coal drop off the end of the travelling grate they are elevated upwardly by the high pressure air issuing from jets 16, and these elevated particles are blasted forwardly towards the input end of the furnace by the stream of high pressure air and limestone particles and the reinjected ash particles so that they fly back until they drop onto the bed adjacent the spreader gate, and they ride "piggy-back" style again through the furnace with the burning coal in the bed.

The heat produced in the furnace may be utilized in various ways. In the subject process the heat rises to a steam drum 30 and passes to flue 32 via a labyrinth passage between baffles 36, 38. The hot gases also heat water drum 34 and the solid particles drop into an ash pan 40 from whence they are reinjected by venturi 29 into the stream of high pressure air and limestone in pipe 26. It should be understood that various boiler and flue configurations are available, the structures in the illustrations being only for purposes of illlustrating the process.

Under-fire air is supplied to the coal in the bed via airbox zones 44, the air feed to which is controlled by valves 46 and supplied by a suitable source of low pressure air. In this process only enough under-fire air is supplied as to burn the coal in the bed without elevating the coal or coal particules to any appreciable extent; and not enough to create hotspots or channeling of localized intense burning through the bed.

In operation of the process, the fuel is supplied at rates that correspond to burning rates required to maintain boiler steaming rates. The high pressure air is supplied at velocities sufficient to cause the burning fuel to rise vertically approximately $2\frac{1}{2}$ to 3 feet. The high pressure air which entrains the limestone particles is preheated by suitable means well known in the art. The heat of the gaseous byproducts burning in the bed, plus that produced by the burning in the fluidized burning zone above the bed comes to about 1500° F. which results in full release of sulfur from the coal, i.e., a complete burn out of the sulfur. Unless complete or virtually complete burn out occurs, about half of the sulfur locks into the the fixed carbon in the coal. The ash particles in the blow back stream bind together and form a clinker and this drops out into the ash bin 18. The limestone particles should be sized at about $\frac{1}{8}$ inches$\times$0.

In conventional bubbling beds or circulating beds, contact time between combustion air and solid fuel particles is only from one to three seconds whereas the residence time in the combustion zone of the subject process can be from six to twelve seconds, depending on grate speed.

When the coal in the bed 10 burns, an atmosphere of sulfur-laden gaseous by-products is created above the bed and it is through this atmosphere that the particles which have been elevated by high pressure air from the jets 16 are blasted by the high pressure air and limestone back over the bed. The result of the reaction of the high pressure air blast and with the entrained limestone particles being that the updraft through the furnace, indicated by the broken arrow, contains very few solid particles, and these drop down into the ash pan 40 as they collide with the baffles 36, 38 in transit to the flue 32.

A feature of the invention is that, by controlling the amounts of sulfur and underfire air the temperature of the atmosphere above the bed can be maintained between 1550° F. and 1750° F. which is the temperature range for optimum reaction of sulfur and limestone.

I claim:

1. A process for burning high-sulfur coal while removing the sulfur therefrom, comprising;

transporting, on a run of an endless grate, a burning bed of high sulfur coal through a furnace from an input end of the furnace to a laterally spaced output end thereof while feeding air upwardly through the bed in quantities and at pressures sufficient only to react with most of the carbon content of the coal in the bed while creating an atmosphere of sulfur-laden gaseous by-products above the bed, free-falling a residue of clinkers and small particles of burned and partly burned coal off the end of the grate run, blowing through the free-falling residue with an upward blast of air of a force sufficient to elevate the small particles upwardly to a level higher than the bed but of insufficient force to divert the clinkers from free-falling into a collector, blasting the elevated particles back through the atmosphere above the burning bed towards the front end of the furnace with a blast of air with limestone particles entrained therein so that the air reacts with at least most of the carbon contents of the particles while the limestone particles react with and grab the sulfur in the atmosphere above the bed, and forming clinkers consisting of the reacted particles, which clinkers drop onto the burning bed and ride thereon through the furnace and drop off at the end of the grate run.

2. In a process as defined in claim 1 the steps of exhausting a stream of hot gaseous by-products containing ash particles from the furnace, collecting the ash particles from the exhaust stream, and re-cycling the collected particles into the furnace with a blast of air having the limestone entrained therein.

3. The process as claimed in claim 1, and controlling the amounts of air fed upwardly through the bed and the amount of air blasted back through the atmosphere above the bed so as to maintain a temperature in said atmosphere in the range of 1550° F. to 1750° F.

* * * * *